US010703000B2

(12) United States Patent
Li et al.

(10) Patent No.: US 10,703,000 B2
(45) Date of Patent: Jul. 7, 2020

(54) NEGATIVE PRESSURE PNEUMTIC HAIR CLIPPER

(71) Applicant: MAOTHER (SUZHOU) ELECTRIC EQUIPMENT CO., LTD., Suzhou (CN)

(72) Inventors: Yi Li, Suzhou (CN); Weiming Song, Suzhou (CN)

(73) Assignee: MAOTHER (SUZHOU) ELECTRIC EQUIPMENT CO., LTD., Suzhou (CN)

( * ) Notice: Subject to any disclaimer, the term of this patent is extended or adjusted under 35 U.S.C. 154(b) by 104 days.

(21) Appl. No.: 16/304,112

(22) PCT Filed: Mar. 9, 2017

(86) PCT No.: PCT/CN2017/076112
§ 371 (c)(1),
(2) Date: Nov. 21, 2018

(87) PCT Pub. No.: WO2017/211101
PCT Pub. Date: Dec. 14, 2017

(65) Prior Publication Data

US 2020/0139564 A1 May 7, 2020

(30) Foreign Application Priority Data

Jun. 6, 2016 (CN) ..... 2016 1 0389626

(51) Int. Cl.
*B26B 19/34* (2006.01)
*B26B 19/44* (2006.01)
*B26B 19/38* (2006.01)

(52) U.S. Cl.
CPC ..... *B26B 19/34* (2013.01); *B26B 19/3846* (2013.01); *B26B 19/3853* (2013.01); *B26B 19/44* (2013.01)

(58) Field of Classification Search
CPC ..... B26B 19/34; B26B 19/28; B26B 19/44; B26B 19/3846; B26B 19/3853
(Continued)

(56) References Cited

U.S. PATENT DOCUMENTS 2,292,453 A * 8/1942 La Mere ..... B26B 13/00 30/216
2,789,786 A 4/1957 Mefford et al.
(Continued)

FOREIGN PATENT DOCUMENTS

CN 2342945 Y 10/1999
CN 101610878 A 12/2009
(Continued)

*Primary Examiner* — Hwei-Siu C Payer
(74) *Attorney, Agent, or Firm* — SZDC Law P.C.

(57) ABSTRACT

A negative pressure pneumatic hair clipper includes a housing and a hair cutting bit mounted on the head of the housing; a negative pressure turbine airway and a suction airway isolated from each other go all the way through the housing; a negative pressure turbine wind motor connected with the hair cutting bit is provided inside the negative pressure turbine airway and, when rotated, can drive the hair cutting bit to perform the hair cutting operation; a suction mouth of the suction airway is disposed near the hair cutting bit; the tail of the housing is connected with an airway hose that is in gas phase communication with the negative pressure turbine airway and the suction airway, with the other end of the airway hose connected with a vacuum cleaner capable of generating negative pressure airflow to drive the negative pressure turbine wind motor to rotate.

8 Claims, 6 Drawing Sheets

(58) Field of Classification Search
USPC ..... 30/124, 133
See application file for complete search history.

(56) References Cited

U.S. PATENT DOCUMENTS

| | | | | | |
|---|---|---|---|---|---|
| 2,807,086 | A | | 9/1957 | Watkins | |
| 2,914,849 | A | * | 12/1959 | Watkins | B26B 19/34 30/133 |
| 3,262,199 | A | * | 7/1966 | Magarian | B26B 19/34 30/133 |
| 3,368,277 | A | | 2/1968 | Vevea | |
| 4,590,675 | A | | 5/1986 | Louw | |
| 4,628,601 | A | * | 12/1986 | Van Slooten | B26B 19/44 30/133 |
| 4,813,716 | A | * | 3/1989 | Lalikos | F16L 37/0885 285/148.14 |
| 4,868,984 | A | * | 9/1989 | Elsherbini | B26B 19/44 30/133 |
| 5,623,764 | A | * | 4/1997 | Cseh | B26B 19/20 30/133 |
| 7,975,385 | B2 | * | 7/2011 | Obermann | B26B 19/44 30/133 |
| 2005/0060893 | A1 | | 3/2005 | Commings | |
| 2010/0058596 | A1 | | 3/2010 | Shim | |
| 2020/0139564 | A1 | * | 5/2020 | Li | B26B 19/3853 |

FOREIGN PATENT DOCUMENTS

| | | | |
|---|---|---|---|
| CN | 104308869 | A | 1/2015 |
| CN | 105856284 | A | 8/2016 |
| DE | 549704 | C | 4/1932 |
| JP | S63125281 | A | 5/1988 |
| JP | H11313991 | A | 11/1999 |
| JP | 2001162065 | A | 6/2001 |
| JP | 2005198966 | A | 7/2005 |
| JP | 2015188723 | A | 11/2015 |
| WO | 2015136562 | A1 | 9/2015 |
| WO | 2016062177 | A1 | 4/2016 |

* cited by examiner

NEGATIVE PRESSURE PNEUMTIC HAIR CLIPPER

CROSS-REFERENCE TO RELATED APPLICATIONS

This application is the national stage application of PCT/CN2017/076112, filed on Mar. 9, 2017, which claims priority to Chinese Patent Application No. 201610389626.5, filed on Jun. 6, 2016, and entitled "A NEGATIVE PRESSURE PNEUMATIC HAIR CLIPPER," which is incorporated herein by reference in its entirety.

TECHNICAL FIELD

The present invention relates to a hair clipper, in particular to a negative pressure pneumatic hair clipper.

BACKGROUND

A hair clipper used in the prior art uses the rotation of an electric motor to drive the hair cutting bit to perform the hair cutting operation. When being used, the hair clipper of this structure needs not only to be brought into direct contact with the organism having the hair cut, but also to be energized, so there is a risk of electric leakage and damage to the organism having the hair cut. In addition, the hair clipper is not equipped with a device that automatically collects shredded hair, so the scattered hair will splash around and pollute the surrounding environment during the hair cutting process.

SUMMARY

Regarding the above issues, an object of the present invention is to provide a negative pressure pneumatic hair clipper with simple structure, environmental protection and safety, which can not only utilize the negative pressure airflow to drive the hair cutting bit to perform the hair cutting operation, but also collect the cut hair under the action of negative pressure airflow to keep the environment clean and tidy.

A technical solution of the present invention is as follows: A negative pressure pneumatic hair clipper is provided, comprising a housing and a hair cutting bit mounted on the head of the housing; a negative pressure turbine airway and a suction airway isolated from each other go all the way through the housing; a negative pressure turbine wind motor connected with the hair cutting bit is provided inside the negative pressure turbine airway and, when rotated, can drive the hair cutting bit to perform the hair cutting operation; a suction mouth of the suction airway is disposed near the hair cutting bit; the tail of the housing is connected with an airway hose that is in gas phase communication with the negative pressure turbine airway and the suction airway, with the other end of the airway hose connected with a vacuum cleaner capable of generating negative pressure airflow to drive the negative pressure turbine wind motor to rotate;

the negative pressure turbine wind motor comprises an air guide rack fixed to the housing, a rotary turbine movably disposed behind the air guide rack, and a transmission component rotatably inserted in the air guide rack, the transmission component having one end connected to the hair cutting bit and the other end coaxially fixed to the rotary turbine; the rotary turbine is fixedly provided on the circumference with a plurality of blades, which are spaced in parallel along the circumferential direction and arranged at an angle to the central axis of the rotary turbine; a plurality of air guide passages spaced in parallel along the circumferential direction are disposed all the way through the air guide rack, with the air exit direction of the air guide passages perpendicular to the blades.

On the basis of the above technical solution, the present invention further includes the following preferred solutions:

The outer edge of the air guide rack sealingly abuts against the airway wall of the negative pressure turbine airway.

The air guide rack comprises a circular inner rack body, a circular outer rack body coaxially sleeved outside the inner rack body, and a plurality of air guide sheets spaced in parallel along the circumferential direction and fixedly connected between the inner and outer rack bodies, the outer rack body sealingly abutting against the airway wall of the negative pressure turbine airway, the air guide passage formed between the adjacent two of the air guide sheets.

The air guide sheets, the inner rack body and the outer rack body form an integrated structure.

The rotary turbine is circumferentially received in the outer rack body.

The transmission component comprises a first shaft and a second shaft disposed coaxially, a planetary reducer connected by transmission between the first and second shafts, and an eccentric wheel fixed at one end of the second shaft and connected to the hair cutting bit, wherein the first shaft is rotatably inserted in the air guide rack, with one end coaxially fixed to the rotary turbine.

The air guide sheet is a curved sheet.

The blade is a curved sheet.

The airway hose is connected to the tail of the housing through a hose joint, which is detachably connected to the tail of the housing through a spring snap provided thereon.

The present invention has the following advantages:

1. The hair clipper of the present invention utilizes the negative air pressure generated by a vacuum cleaner instead of a conventional electric motor as a power source to drive the hair clipper to work, avoiding the risk of electric shock and saving electric energy.

2. Besides, the negative pressure airflow generated by the vacuum cleaner can quickly inhale and collect the shredded hair, which prolongs the service life of the cutting bit while ensuring the cleanliness of the surrounding environment. Moreover, the suction mouth of the suction airway can straighten the hair for trimming when in operation, simulating the hairdresser's movement and offering a strong sense of experience.

3. The hair clipper of the present invention uses the negative pressure airflow generated by the vacuum cleaner as a shearing power source to drive the cutting bit to operate, and also uses the negative pressure airflow to collect the shredded hair, which is ingenious and practical.

4. The air guide rack and the rotary turbine of the negative pressure turbine wind motor have a special structure, which greatly increases the force exerted by the negative pressure airflow on the rotary turbine, so that the rotary turbine can rotate faster and more powerfully under the driving of the negative pressure airflow, thereby improving the efficiency of hair cutting.

5. A planetary reducer is adopted for the negative pressure turbine wind motor to improve the power of the hair cutting bit and ensure the smooth cutting operation of the same.

BRIEF DESCRIPTION OF DRAWINGS

The present invention will be further described below with reference to drawings and examples.

Figure 1:
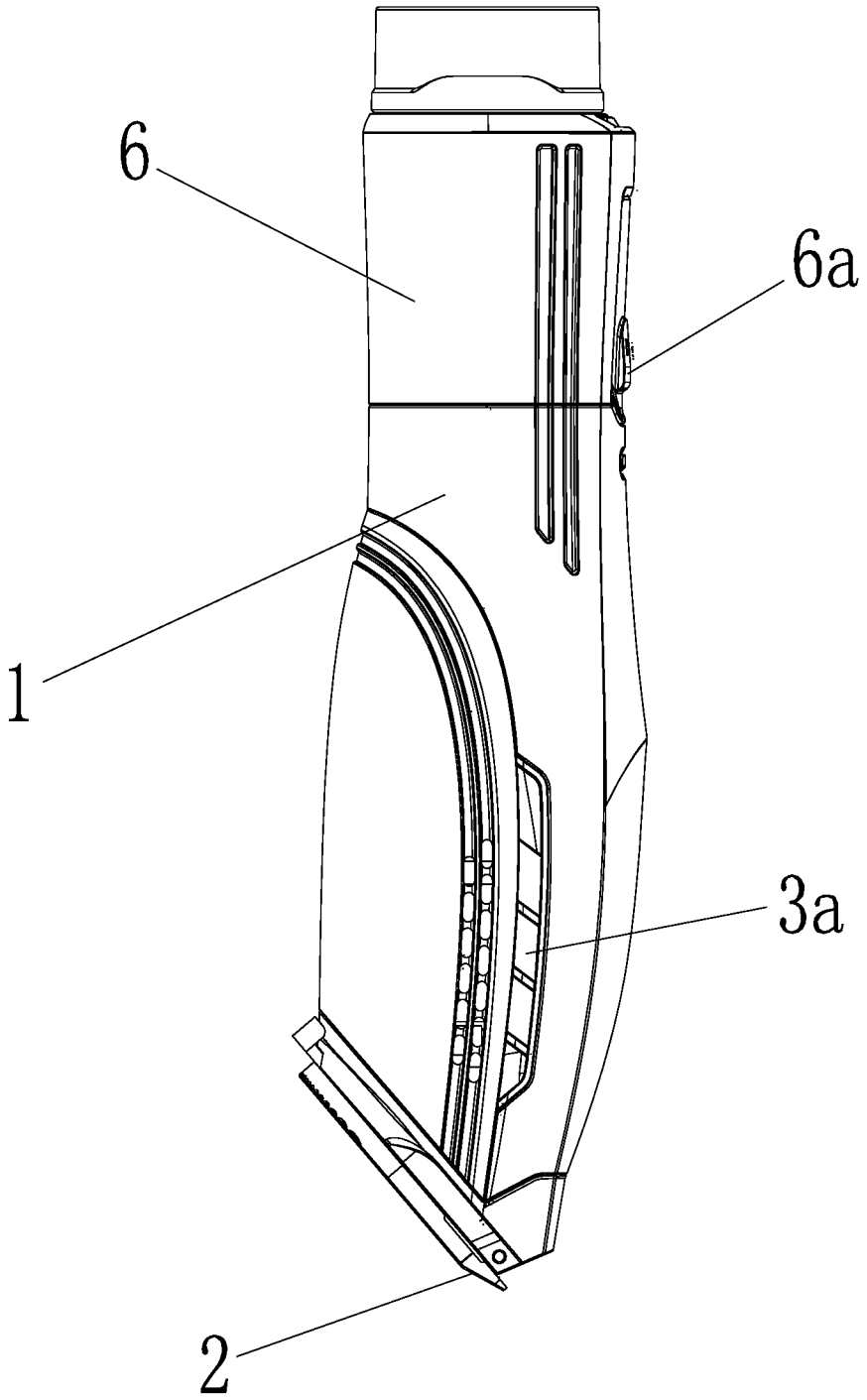
FIG. 1 is a perspective view of the negative pressure pneumatic hair clipper in an example of the present invention.
Figure 2:
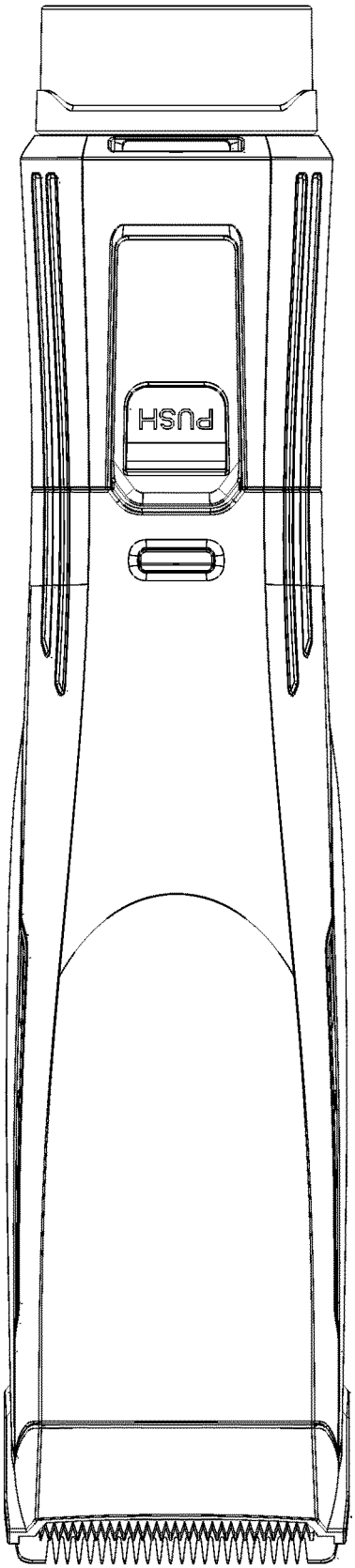
FIG. 2 is a plan view of the negative pressure pneumatic hair clipper in the example of the present invention.
Figure 3:
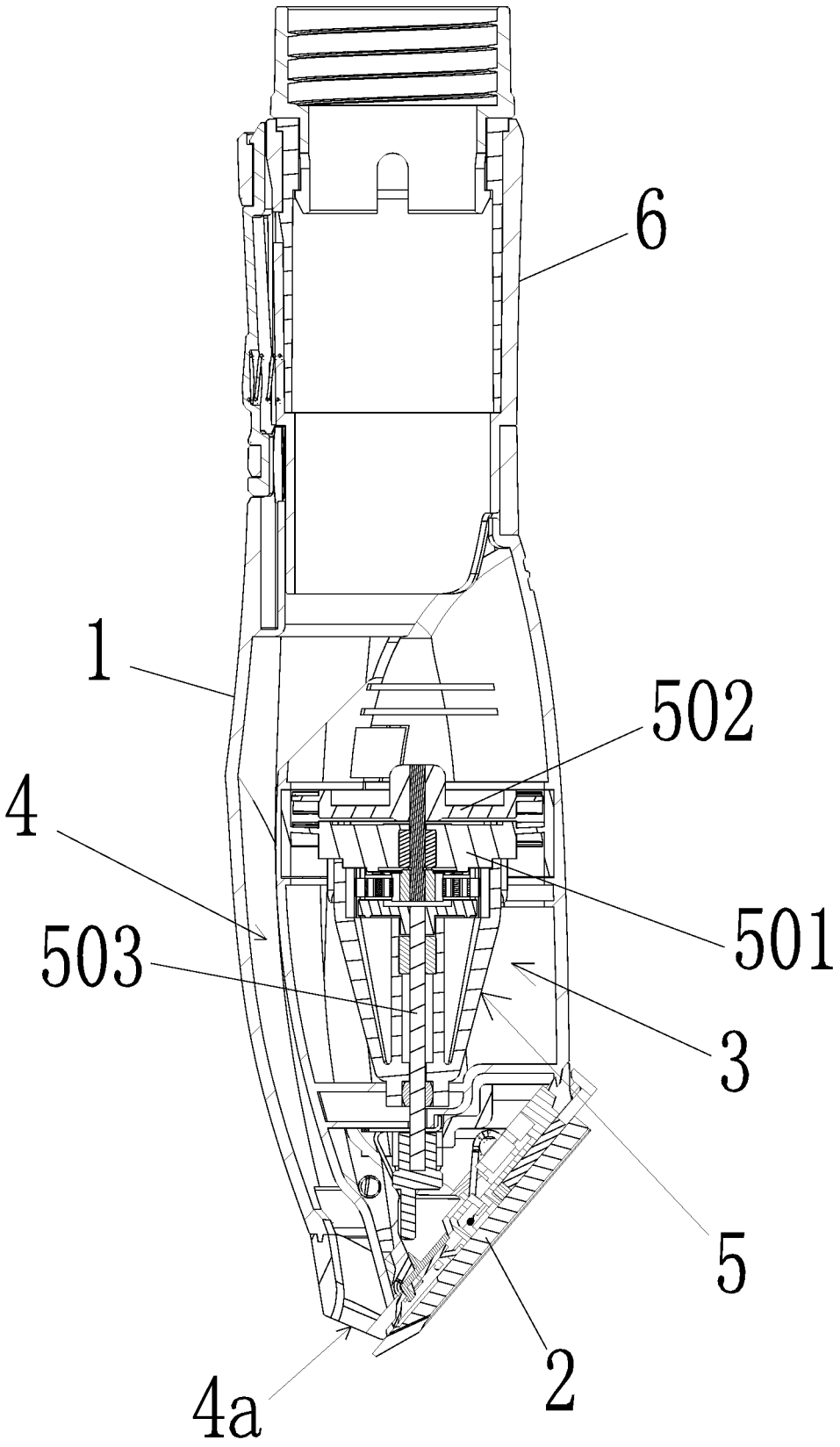
FIG. 3 is a cross-sectional view of the negative pressure pneumatic hair clipper in the example of the present invention.

Wherein: 1. A housing; 2. a hair cutting bit; 3. a negative pressure turbine airway; 3*a*. a negative pressure air inlet; 4. a suction airway; 4*a*. a suction mouth; 5. a negative pressure turbine wind motor; 501. an air guide rack; 501*a*. an air guide passage; 501*b*. an inner rack body; 501*c*. an outer rack body; 501*d*. an air guide sheet; 502. a rotary turbine; 502*a*. a blade; 503. a transmission component; 503*a*. a first shaft; 503*b*. a second shaft; 503*c*. a planetary reducer; 503*d*. an eccentric wheel; 503*e*. a support sleeve; 6. a hose joint; and 6*a*. a spring snap.

DETAILED DESCRIPTION OF PREFERRED EMBODIMENTS

Example: FIGS. 1 to 7 show a specific example of the negative pressure pneumatic hair clipper of the present invention, wherein the hair clipper comprises a housing 1, on the head of which is mounted a hair cutting bit 2. A negative pressure turbine airway 3 and a suction airway 4 isolated from each other go all the way through the housing 1. A negative pressure turbine wind motor 5 connected with the hair cutting bit 2 is provided inside the negative pressure turbine airway 3 and, when rotated, can drive the hair cutting bit 2 to perform the hair cutting operation. A suction mouth 4*a* of the suction airway 4 is disposed near the hair cutting bit 2 to inhale the hair. The tail of the housing 1 is connected with an airway hose (not shown) that is in gas phase communication with the negative pressure turbine airway 3 and the suction airway 4, with the other end of the airway hose connected with a vacuum cleaner (not shown) capable of generating negative pressure airflow to drive the negative pressure turbine wind motor 5 to rotate. The housing 1 is specifically provided with a negative pressure air inlet 3*a* communicating with the negative pressure turbine airway 3, so as to ensure that the negative pressure turbine airway 3 can generate stable negative pressure airflow during operation. The negative pressure air inlet 3*a* and the suction mouth 4*a* are located at different positions.

The connection between the negative pressure turbine wind motor 5 and the hair cutting bit 2 is similar to the connection between an electric motor and a hair cutting bit in the conventional art.

Figure 4:
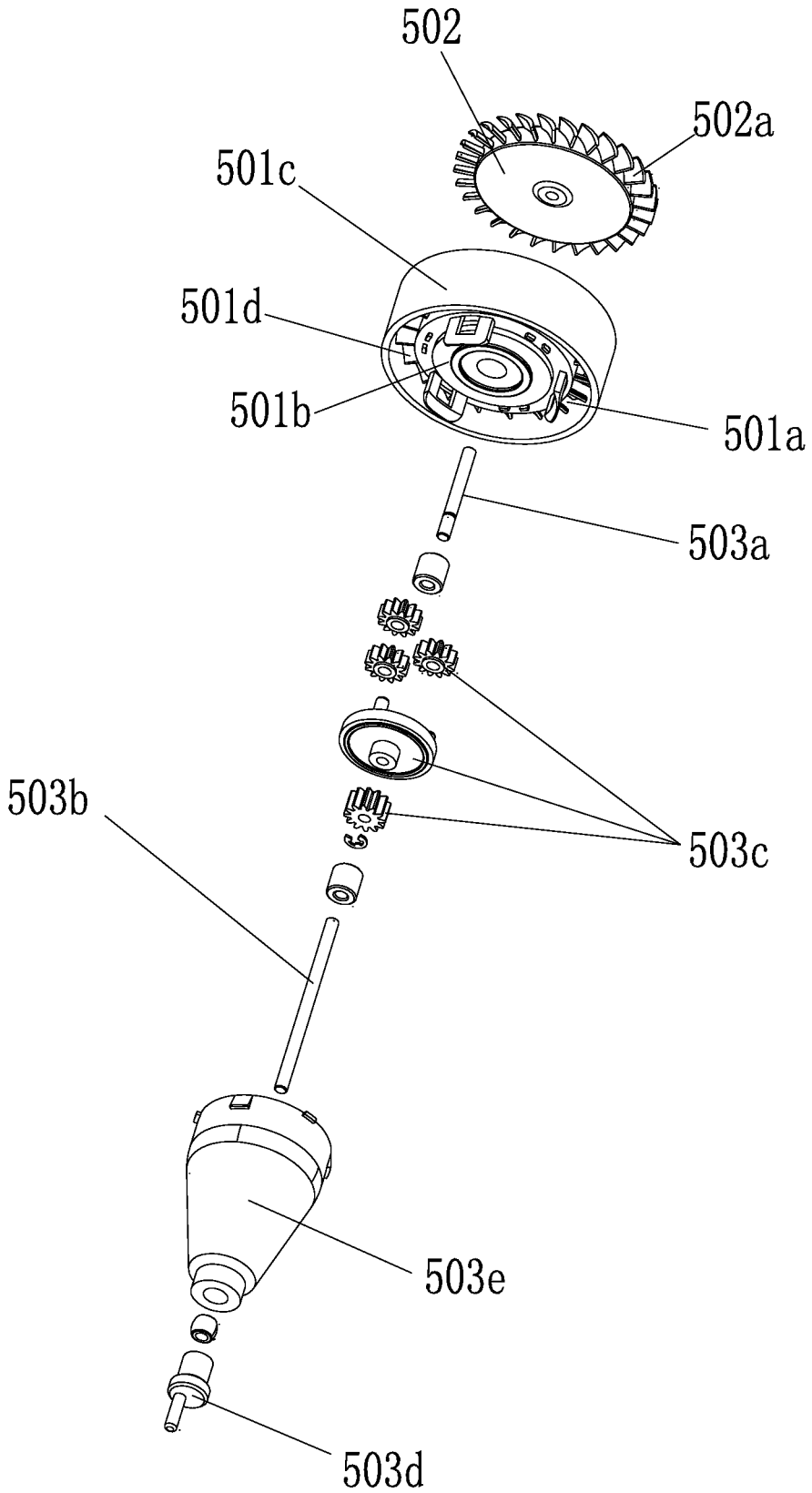
FIG. 4 is an exploded view of the negative pressure pneumatic hair clipper in the example of the present invention.
Figure 5:
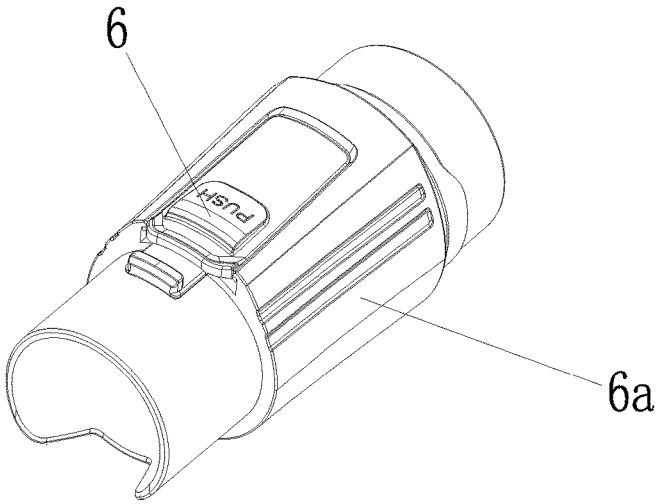
FIG. 5 is a perspective view of a hose joint in the example of the present invention.
Figure 6:
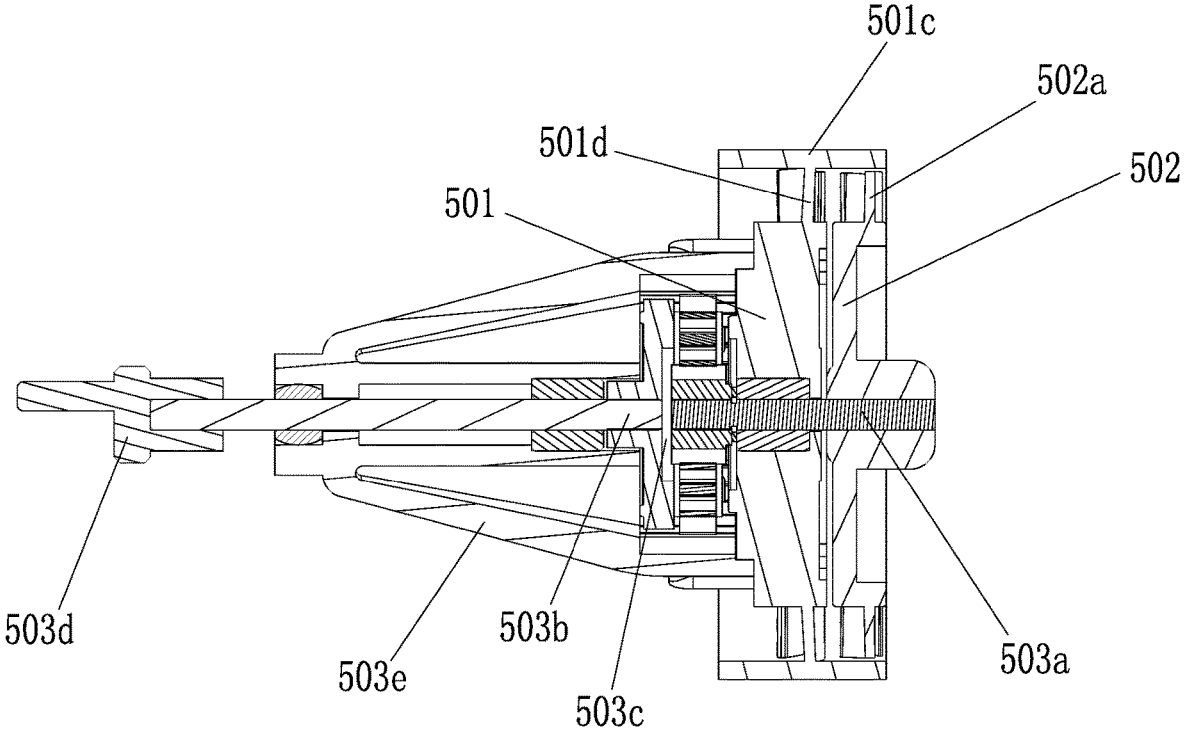
FIG. 6 is a cross-sectional view of a transmission component in the example of the present invention.
Figure 7:
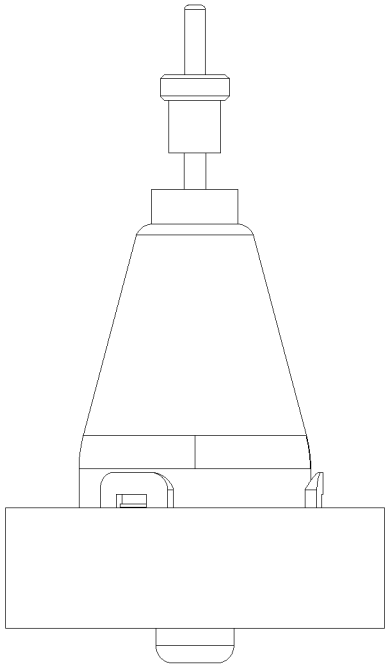
FIG. 7 is a plan view of the transmission component in the example of the present invention.

The structure of the negative pressure turbine wind motor 5 in this example, as shown in FIGS. 4, 6 and 7, comprises an air guide rack 501 fixed to the housing 1, a rotary turbine 502 movably disposed behind the air guide rack (i.e., downstream in the direction of the negative pressure airflow), and a transmission component 503 having one end connected to the hair cutting bit 2 and the other end coaxially fixed to the rotary turbine 502. The transmission component 503 is rotatably inserted in the air guide rack 501. The rotary turbine 502 is fixedly provided on the circumference with a plurality of blades 502*a*, which are arranged at an angle to the central axis of the rotary turbine 502, that is, the blades 502*a* are not parallel to the central axis of the rotary turbine 502, generally having an angle of 30° to 60°. A plurality of air guide passages 501*a* spaced in parallel along the circumferential direction are disposed all the way through the air guide rack 501, with the air exit direction of the air guide passages 501*a* perpendicular to the blades 502*a*; the term "perpendicular" as used herein means "substantially perpendicular" instead of being strictly perpendicular having an exact angle of 90° between the air exit direction of the air guide passage and the blade. Obviously, the air guide passages 501*a* are also arranged at an angle to the central axis of the rotary turbine 502, rather than being arranged in parallel.

In practical applications, the vacuum cleaner is turned on to generate negative pressure airflow flowing from the negative pressure turbine airway and the suction airway to the airway hose and the vacuum cleaner; wherein the high negative pressure airflow in the negative pressure turbine airway flows through the air guide passage 501*a* on the air guide rack 501 to just blow toward the blade 502*a* on the rotary turbine 502, thereby pushing the rotary turbine 502 to rotate at a high speed; the rotary turbine 502 drives the hair cutting bit 2 to perform the hair cutting operation through the transmission component 503; meanwhile, the cut hair is quickly inhaled into the suction airway 4 by the vacuum suction force at the suction mouth 4*a* of the suction airway 4, and enters the vacuum cleaner via the airway hose, so that the hair will remain neither in the surrounding environment to cause environmental pollution nor on the cutting bit to reduce the service life of the cutting bit; moreover, the suction mouth 4*a* can straighten the hair for trimming when in operation, simulating the hairdresser's movement and offering a strong sense of experience.

It is not difficult to see that the air guide rack 501 and the rotary turbine 502 of the special structure described above greatly increase the force exerted by the negative pressure airflow on the rotary turbine 502, so that the rotary turbine 502 can rotate faster and more powerfully under the driving of the negative pressure airflow, thereby improving the efficiency of hair cutting.

In this example, the outer edge of the air guide rack 501 sealingly abuts against the airway wall of the negative pressure turbine airway 3, such that the wind in the negative pressure turbine airway 3 all flows through the air guide passage 501*a* on the air guide rack 501 and blows toward the blade 502*a* to increase the speed of the wind blowing toward the blade 502*a* on the rotary turbine 502.

The air guide rack 501, with the structure as shown in FIG. 4, comprises a circular inner rack body 501*b*, a circular outer rack body 501*c* coaxially sleeved outside the inner rack body, and a plurality of air guide sheets 501*d* spaced in parallel along the circumferential direction and fixedly connected between the inner and outer rack bodies. The air guide passage 501*a* is formed between the adjacent two of the air guide sheets 501*b*. The outer edge of the wind guide rack 501 is formed on the outer rack body 501*c*, that is, the outer rack body 501*c* sealingly abuts against the airway wall of the negative pressure turbine airway 3. Besides, the air guide sheets 501*d*, the inner rack body 501*b* and the outer rack body 501*c* form an integrated structure.

As shown in FIG. 6, the rotary turbine 502 is circumferentially received in the outer rack body 501*c*, so that the efficiency of the negative pressure airflow for driving the rotary turbine 502 can be further improved.

Moreover, the air guide sheet 501*d* and the blade 502*a* in this example are both configured to be a curved sheet, thereby further improving the efficiency of the negative pressure airflow for driving the rotary turbine 502.

The transmission component 503, with the structure as shown in FIG. 4, comprises a first shaft 503*a* and a second shaft 503*b* disposed coaxially, a planetary reducer 503*c* connected by transmission between the first and second shafts, and an eccentric wheel 503*d* fixed at one end of the second shaft and connected to the hair cutting bit 2, wherein the first shaft 503*a* is rotatably inserted in the air guide rack 501, with one end coaxially fixed to the rotary turbine 502.

The planetary reducer 503*c*, generally having a reduction ratio of 1:4 or 1:3, is used to reduce the transmission speed and improve the transmission force, so as to ensure that the hair cutting bit 2 receives sufficient force to make the cutting operation smoothly.

In this example, in order to prevent the second shaft 503*b* from shifting and to ensure the positional stability of the central axis of the second shaft 503*b*, a support sleeve 503*e* is further fixedly coupled to the housing 1, and the second shaft 503 *b* is rotatably supported in the support sleeve 503*e*. The air guide rack 501 is engaged with the support sleeve 503*e*.

The number of the air guide passages 501*a* in this example is different from the number of the blades 502*a*.

The airway hose is connected to the tail of the housing 1 through a hose joint 6, which is detachably connected to the tail of the housing 1 through a spring snap 6*a* provided thereon.

The example described above is only intended to illustrate the technical concept and the features of the present invention, with the purpose of enabling those skilled in the art to understand the present invention without limiting the scope of the present invention. Any equivalent alteration or modification made according to the spiritual substance of the main technical solution of the present invention will all fall within the scope of protection of the present invention.

What is claimed is:

1. A negative pressure pneumatic hair clipper, comprising a housing and a hair cutting bit mounted on a head of the housing; a negative pressure turbine airway and a suction airway isolated from each other go all the way through the housing; a negative pressure turbine wind motor connected with the hair cutting bit is provided inside the negative pressure turbine airway and, when rotated, can drive the hair cutting bit to perform the hair cutting operation; a suction mouth of the suction airway is disposed near the hair cutting bit; a tail of the housing is connected with one end of an airway hose that is in gas phase communication with the negative pressure turbine airway and the suction airway, with the other end of the airway hose connected with a vacuum cleaner capable of generating negative pressure airflow to drive the negative pressure turbine wind motor to rotate;

wherein the negative pressure turbine wind motor comprises an air guide rack fixed to the housing, a rotary turbine movably disposed behind the air guide rack, and a transmission component rotatably inserted in the air guide rack, the transmission component having one end connected to the hair cutting bit and the other end coaxially fixed to the rotary turbine; the rotary turbine is fixedly provided on its circumference with a plurality of blades, which are uniformly spaced in a circumferential direction and arranged at an angle to the central axis of the rotary turbine; a plurality of air guide passages uniformly spaced in the circumferential direction are disposed all the way through the air guide rack and also arranged at an angle to the central axis of the rotary turbine, with an air exit direction of the air guide passages perpendicular to the blades, and wherein the transmission component comprises a first shaft and a second shaft disposed coaxially, a planetary reducer connected by transmission between the first and second shafts, and an eccentric wheel fixed at one end of the second shaft and connected to the hair cutting bit, wherein the first shaft is rotatably inserted in the air guide rack, with one end of the first shaft coaxially fixed to the rotary turbine.

2. The negative pressure pneumatic hair clipper according to claim 1, the wherein an outer edge of the air guide rack sealingly abuts against an airway wall of the negative pressure turbine airway.

3. The negative pressure pneumatic hair clipper according to claim 2, wherein the air guide rack comprises a circular inner rack body, a circular outer rack body coaxially sleeved outside the inner rack body, and a plurality of air guide sheets uniformly spaced in the circumferential direction and fixedly connected between the inner and outer rack bodies, the outer rack body sealingly abutting against the airway wall of the negative pressure turbine airway, a respective one of the air guide passages formed between adjacent two of the air guide sheets.

4. The negative pressure pneumatic hair clipper according to claim 3, wherein the air guide sheets, the inner rack body and the outer rack body form an integrated structure.

5. The negative pressure pneumatic hair clipper according to claim 3, wherein the rotary turbine is circumferentially received in the outer rack body.

6. The negative pressure pneumatic hair clipper according to claim 3, wherein each of the air guide sheets is a curved sheet.

7. The negative pressure pneumatic hair clipper according to claim 1, wherein each of the blades is a curved sheet.

8. The negative pressure pneumatic hair clipper according to claim 1, wherein the airway hose is connected to the tail of the housing through a hose joint, which is detachably connected to the tail of the housing through a spring snap provided thereon.

* * * * *